US006298854B1

(12) United States Patent
Sundstrom

(10) Patent No.: US 6,298,854 B1
(45) **Date of Patent: *Oct. 9, 2001**

(54) UROLOGY AND GYNECOLOGY BENCH

(76) Inventor: Christer Sundstrom, Forradsvagen 14, Ronninge S-144 22 (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/875,241

(22) PCT Filed: Jan. 23, 1996

(86) PCT No.: PCT/SE96/00062

§ 371 Date: Jul. 22, 1997

§ 102(e) Date: Jul. 22, 1997

(87) PCT Pub. No.: WO96/22758

PCT Pub. Date: Aug. 1, 1996

(30) Foreign Application Priority Data

Jan. 24, 1995 (SE) ..... 9500225

(51) Int. Cl.[7] ..... A61G 15/00

(52) U.S. Cl. ..... 128/845; 5/624; 606/241; 606/242

(58) Field of Search ..... 5/624, 602, 621, 5/649, 650, 618, 619; 128/845, 846; 602/32–40; 606/241–242

(56) References Cited

U.S. PATENT DOCUMENTS

| | | | | |
|---|---|---|---|---|
| 540,939 | * | 6/1895 | Barton | 5/624 |
| 1,749,867 | * | 3/1930 | Allison | 5/624 |
| 3,227,439 | * | 1/1966 | Carlson | 5/624 |
| 3,233,255 | * | 2/1966 | Propst | 5/624 |

* cited by examiner

*Primary Examiner*—Michael A. Brown
(74) *Attorney, Agent, or Firm*—Dowell & Dowell, P.C.

(57) ABSTRACT

An improved urological or gynecological examination- and treatment bench of the kind which comprises a frame having a lowermost portion and an uppermost portion, preferably designed as a pivotal arm and raisable and lowerable carrying a back cushion (11) that is individually adjustable at least to its angular position with respect to the horizontal plane, and at least one seat cushion (12) which is similarly individually adjustable to its angular position with respect to the horizontal plane. At least one of the pivatal axis for the angular adjustment of the back cushion (11) or the seat cushion (12) may be released and is arranged in such a manner that it is adjustable in dependence of a change of position of the pivotal axis of the other cushion, so that the two cushions are jointly movable under operation of only one of them and while retaining their mutual angular position.

4 Claims, 3 Drawing Sheets

UROLOGY AND GYNECOLOGY BENCH

BACKGROUND OF THE INVENTION

1. Field of the Invention

The present invention relates to an improved urology and gynecology bench of the kind which is used at urological and gynecological examinations and treatment of various kinds.

The invention has been created in connection with certain urological examinations, and, therefore, it will be disclosed essentially with reference to such use, but it is by no means restricted to that field of use only.

2. Description of the Related Art

An appreciated urological and gynecological examination and treatment bench comprises, in its basic design, a preferably easily movable frame which carries a back cushion and a seat cushion, besides ordinary arm, leg and foot supports etc. The frame comprises a lowermost frame portion which carries an arm that is pivotally connected thereto at the lowermost end and thereof and which caries the back cushion and the seat cushion at the outer, uppermost end thereof. Therefore, these cushions may be elevated and lowered by a corresponding movement of the pivotally journalled arm. The cushions may also be swung individually in order to adjust their inclination in relation to a horizontal plane. Simplified, the cushions may be described, in one position, as forming a horizontal table, and, in another position, may be described as forming a chair. The angular positions of the cushions are infinitely variable and the adjustment of the cushions may be supported by gas-springs or the like. Normally, both the raising and lowering movements of the pivotal arm and the adjustment of the angular positions of the two cushions is performed by means of suitable motors. Of course, a known examination and treatment bench has the necessary support and locking devices to secure the elevational and inclinational positions of the cushions. Normally, the back cushion may also be folded backwardly beyond a horizontal position into a shock position, wherein the patient, resting on his back, has his head situated in a lower position than his body.

A urological and gynecological examination bench of the just described kind is very adaptable for various demands because of the possibility to individually adjust the two cushions both with respect to their height position and their inclinational position. However, this possibility to individually adjust also involves a not unimportant problem in certain specific cases. Thus, there exists a need for a simple variation of the angular position of the cushions, in one single step, and without variation of their mutual angular position.

SUMMARY OF THE INVENTION

The present invention provides a device that meets the above mentioned need.

To this end, the improved urological or gynecological examination and treatment bench comprises a frame having a lowermost portion and an uppermost portion, preferably designed as a pivotal arm and raisable and lowerable carrying a back cushion that is individually adjustable, at least to its angular position with respect to the horizontal plane, and a seat cushion which is similarly individually adjustable, at least to its angular position with respect to the horizontal plane. According to the invention, at least one of the pivotal axes for the angular adjustment of the back cushion or the seat cushion may be released and is arranged in such a manner that is adjustable in dependence of a change of position of the pivotal axis of the other cushion, so that the two cushions are movable together under operation of only one of them and while retaining their mutual angular position.

Preferable, the pivot axis of the back cushion and the seat cushion are arranged in movable brackets at each side of the examination and treatment bench. The brackets are lockable in fixed position.

Preferably, the device according to the invention should also be able to be incorporated into existing examination and treatment benches.

BRIEF DESCRIPTION OF THE DRAWINGS

The invention will be disclosed in more detail below with reference to the accompanying drawings.

FIGS. 4, 5, 6 and 7, respectively, illustrate two different ways of employing the examination and treatment bench incorporating a device according to the present invention, wherein FIGS. 4 and 5 show a "German" model whereas FIGS. 6 and 7 show an "American" model.

DESCRIPTION OF THE PREFERRED EMBODIMENT

Figure 1:
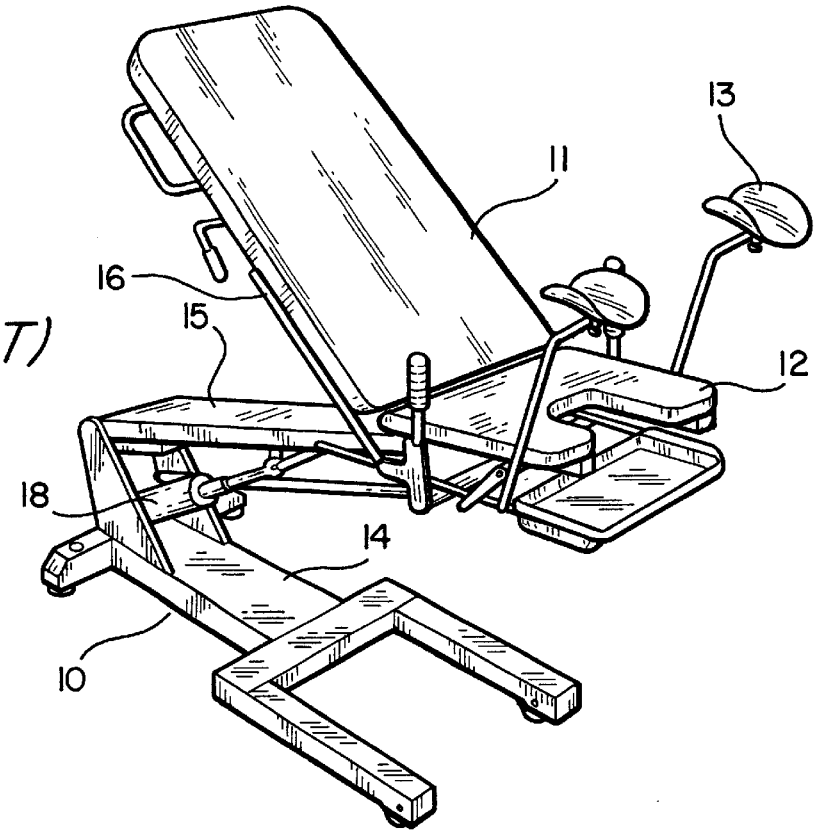
FIG. 1 (PRIOR ART)
FIG. 1 is a perspective view of a prior art examination and treatment bench and shows the type of equipment which the device according to the present invention is intended to be utilized.
Figure 2:
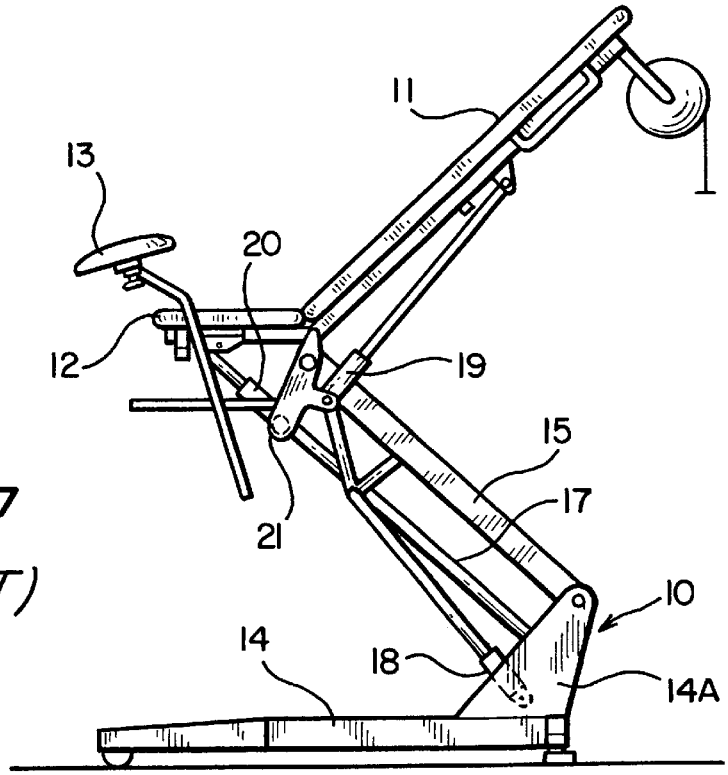
FIG. 2 (PRIOR ART)
FIG. 2 is a side view of the examination and treatment bench in FIG. 1.

The urological and gynecological examination and treatment bench, shown in FIGS. 1 and 2 as an example of the type of equipment in which the device according to the invention is intended to operate. The bench includes an easily movable frame 10 which carries a back cushion 11 and a seat cushion 12, besides the usual arms rest, legs rest 13 and foot rest. (The arm and foot rests are not shown in FIG. 1 and 2).

The frame 10 comprises a lowermost frame portion 14, which carries an arm 15 that is pivotally journalled at its lowermost end, and which caries the back cushion 11 and seat cushion 12 at its outermost end. Therefore, these cushions may be elevated and lowered by movement of the pivotally journalled arm 15. The cushions 11, 12 may also be swung individually in order to vary their inclination with respect to a horizontal plane. To simplify, the cushions 11, 12, in one position thereof, form a horizontal table, whereas, in another position they form a chair, as will be disclosed in more detail below.

The inclined positions of the cushions 11, 12 are infinitely adjustable, and the positioning of the cushions 11, 12 may be sustained by gas springs 16, 17 or the like.

The elevational and lowering movements of the pivotal arm 15 may be performed by means of a suitable positioning motor assembly 18 which is pivotally mounted at 18A and 18B. The swinging motion of the back cushion to adjust the inclined position thereof in relation to the horizontal is performed by means of a second positioning motor assembly 19 which is pivotally connected at 19A to the back cushion frame 11A and to the bracket 21 at 19B. The swinging motion of the seat cushion 12 to adjust the inclined position thereof in relation to the horizontal is performed by a suitable third positioning motor assembly 20 pivotally connected to the seat cushion at 20A and to the bracket 21 at 20B.

A bracket 14A is provided on the lowermost frame portion 14 in which the lowermost end of the pivotal arm 15 is pivotally journalled. The lowermost end of the gas spring 17 is also pivotally journalled in the bracket 14A. The upper bracket 21, in which the uppermost end of the pivotal arm 15 and the uppermost end of the gas spring 17 are pivotally connected at some distance from each other, form together with the pivotal arm 15 and the gas spring 17 a parallelogram linkage system. The linkage system ensures that the back cushion 11 and the seat cushion 12, which both are pivoted to the uppermost bracket as above described to maintain their mutual angular positions while being raised and lowered in relation to the floor. Of course, these angular positions are dependent on the control of the positioning motor assemblies 19, 20. Due to its function as an immovable support for the lowermost ends of the positioning motor assemblies 19, 20, the bracket 21 is also a fixed motor support.

To stabilize the bench, there is preferably provided an uppermost bracket 21 and the necessary gas springs etc. in pairs on both sides of the bench, although only one member of the respective pairs is shown in the drawings.

Figure 3:
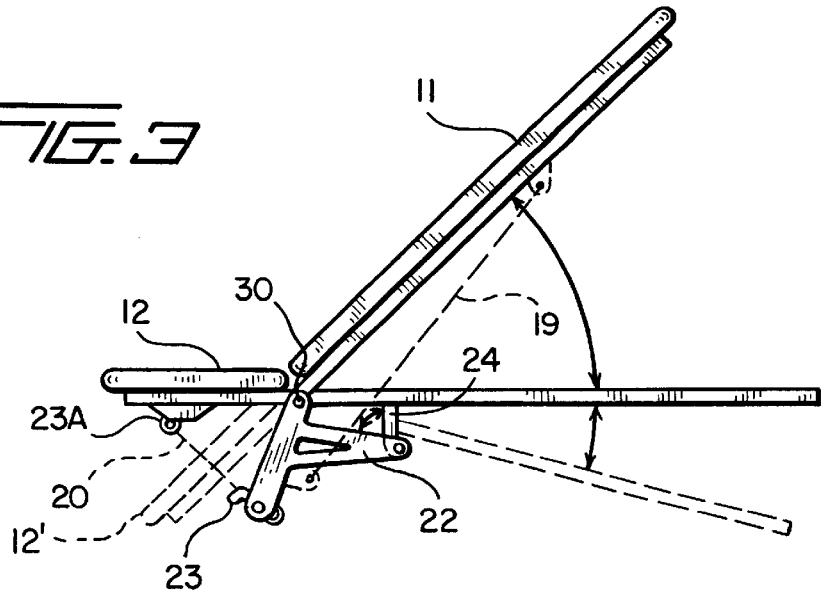
FIG. 3 is a side view of a portion of an examination and treatment bench, provided with one embodiment of the improvement according to the present invention.

In the preferred embodiment of the device according to the invention, as shown in FIG. 3, the fixed motor support bracket 21 is supplemented by a movable bracket 22, which may be locked in the position shown relative to the bracket 21 by means of a latch 23. When the bracket 22 is in its locked position, it operates in the same manner as has been disclosed above with reference to the fixed support bracket 21 as the pivot point 19B for the positioning motor assembly 19 is retained at a fixed distance from the pivot point 20B between the positioning motor assembly 20 and the bracket 22. This means that the back cushion 11 and the seat cushion 12 are individually adjustable into their different angular positions by means of their respective positioning motor assemblies about a pivot axis 30.

The movable bracket 22 has an upwardly foldable strut 24 which may rest against the frame 11A of the back cushion 11 in the plane position thereof, as shown. Now, if the frame of the back cushion is swung downwardly into a "shock-position", as is shown by dashed lines in FIG. 3, the movable bracket 22 is urged clockwise according to the arrow in FIG. 3, so that the latch 23 may be released from the bracket 22. If the frame 11A of the back cushion 11 is then swung upwardly or downwardly, the movable bracket 22 and therewith the frame of the seat cushion will follow this swinging motion while the angular position of the seat cushion, in relation to the frame of the back cushion is retained.

Figure 4:
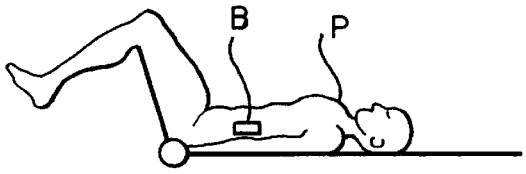
Figure 5:
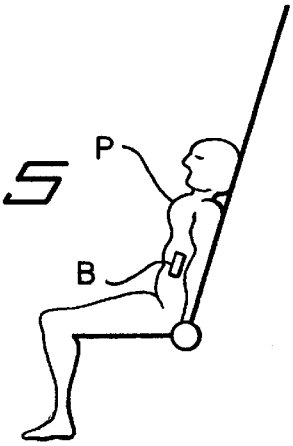

As mentioned above and as FIGS. 4 and 5 illustrate, one way of utilizing the device according to the invention in an urological and gynecological examination bench is shown. According to FIG. 4, a patient P is placed on the back cushion 11 with his legs angled upwardly. This position is, according to a "German" model, considered to be most suitable for e.g. insertion of a catheter into the urine bladder B. When it has been ascertained that the tip of the catheter has been introduced into the desired position, the back cushion 11 and the seat cushion 12, while retaining their angular relationship, will be swung jointly and simultaneously into such a position that the patient become sitting with his weight resting essentially on the seat cushion 12, in which case the urine bladder of the patient will thus be disposed at an ordinary height above the outlet, and the urine pressure thus becomes ordinary.

Figure 6:
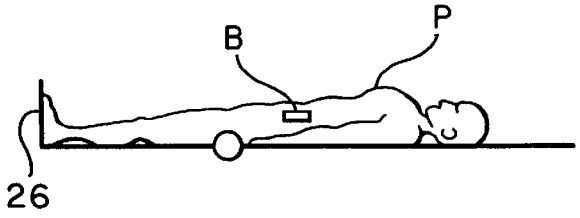
Figure 7:
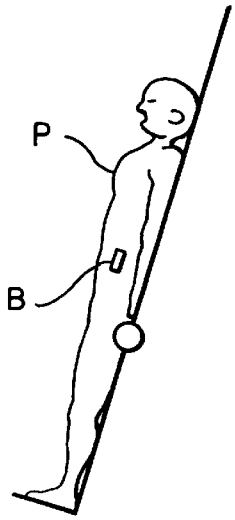

According to FIGS. 6 and 7, the patient P is placed, resting on his back, on the now horizontal back cushion/seat cushion unit, completed by suitable foot-supports 26. This unit has, according to the "American" model a slightly lower seat cushion than in the "German" model, and is maintained in its entirety in horizontal position for introduction of a catheter or the like. When the catheter has been introduced satisfactorily, the entire unit, comprising the seat cushion and the back cushion, is swung into a generally vertical position, as shown in FIG. 7, in which the patient becomes standing. It should be noted that the urine bladder B, also in this case, will be disposed at an ordinary level, so that the urine pressure becomes ordinary.

From the above description it should be clear that the invention, allows the release of at least one of the individually adjustable back and seat cushions from its ordinary support bracket 22 to instead connect the released cushion to the other one of the cushions in such a manner that the two cushions become jointly adjustable while retaining their angular relationship with respect to one another.

The above "mechanical" version of the device according to the invention has been described. It should be noted that an "operational" version may be conceived wherein operational impulses of the positioning motors are controlled in such a manner that, in one case, the back cushion and the seat cushion are individually adjustable, whereas, in an alternative case, they are interconnected in such a manner that they are jointly adjustable while retaining an unchanged angular relationship to each other, in which case, only one of the cushions need be adjusted while the other simply follows the movement of the first one.

Figure 8:
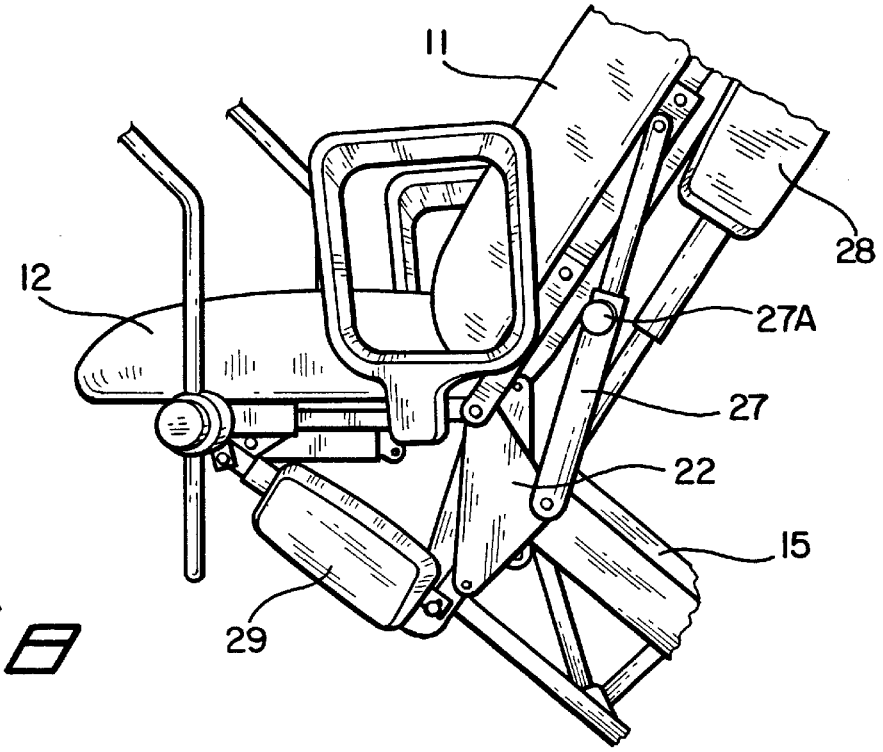
FIGS. 8 and 9 illustrate details of a slightly further developed embodiment of the device according to the invention in two positions of the back cushion and seat cushion, respectively, shown as examples.
Figure 9:
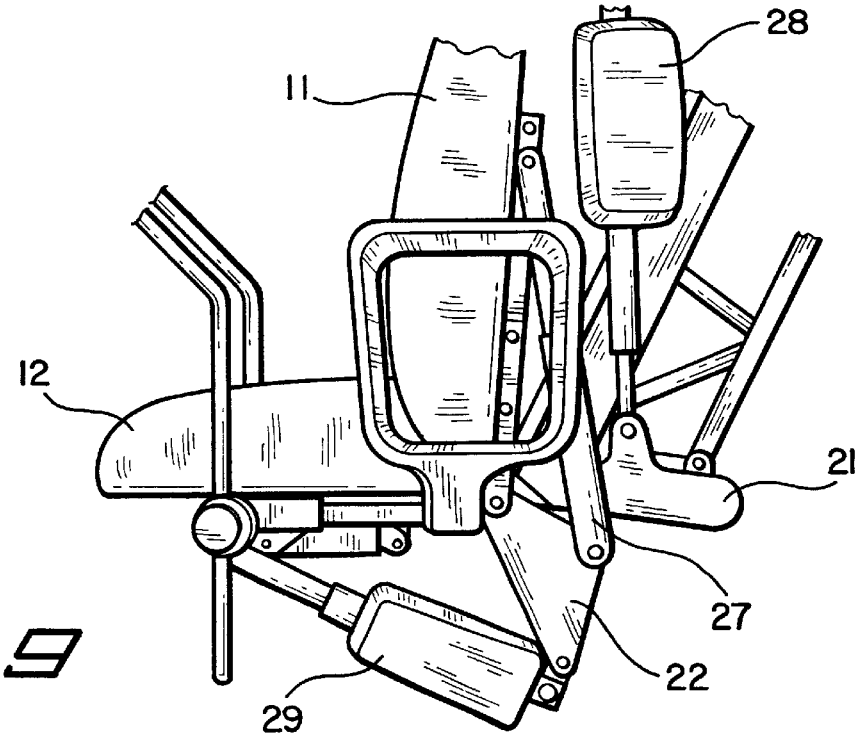

The embodiment as shown in FIGS. 8 and 9, which is slightly further improved as compared to the above described embodiment comprises, telescopically extendable struts 27 between the movable bracket 22 and the back cushion 11 (or, more precisely, the frame 11A thereof). One such strut 27 is provided on each side of the table. The struts 27 are adapted to be locked automatically in predetermined positions, such as by a resilient pin 27A in one portion of the strut entering a suitable hole in the other portion of the strut. Of course, a plurality of different, preferably easily releasable locking means are conceivable for interlocking the parts of the telescopic struts in the desired positions. It should be realized that by locking or unlocking, respectively, the struts, that the back and seat cushions 11, 12 move either jointly, preferably by operation of a suitable positioning motor 28, or individually and entirely independent of each other, preferably by operation of the positioning motors 28 and 29, respectively.

What is claimed is:

1. In a urological or gynecological examination and treatment bench which includes a frame (10) having a lower portion (14) and an upper portion (15), said upper portion being pivotally adjustable at one end with respect to said lower portion so as to raise and lower an outer end thereof, said outer end carrying a back member (11) and first means (19, 28) for individually adjusting an angular position of said back member with respect to a horizontal plane, a seat member (12) and a second means (20, 29) for individually adjusting an angular position of said seat member with respect to the horizontal plane, the improvement comprising; a fixed bracket (21) carried by said outer end of said upper frame portion, said first means for individually adjusting being mounted to said fixed bracket, a movable bracket (22) carried by said outer end of said upper frame portion, said seat member and said back member being pivotable about a pivot axis (30) to said fixed bracket and said movable bracket, said second means (20, 29) for individually adjusting said seat member (12) being pivotally connected to said movable bracket (22), and locking means (27, 27A, 23) for releasably securing said movable bracket (22) in a fixed orientation relative to said fixed bracket whereby said back member and said seat member are thereafter simultaneously moveable while being in a constant angular relationship to one another by adjustment of one of said first means for individually adjusting or said second means for individually adjusting.

2. The urological or gynecological examination and treatment bench of claim 1 in which said locking means includes a latch (23) for releasing engaging said movable bracket such that said movable bracket remains in fixed relative orientation with respect to said fixed bracket until said latch is released from said movable bracket.

3. The urological or gynecological examination and treatment bench of claim 2 in which said movable bracket includes a foldable strut (24) for selectively engaging said back member when said back member is oriented in a generally horizontal position.

4. The urological or gynecological examination and treatment bench of claim 1 wherein said locking means includes an extendable strut (27) pivotally connected between said back member and said movable bracket and means (27A) for retaining said extendable strut in an adjusted position.

* * * * *